US006758504B2

(12) United States Patent
Mandall

(10) Patent No.: US 6,758,504 B2
(45) Date of Patent: Jul. 6, 2004

(54) ELECTROMAGNETIC DOOR LOCK

(76) Inventor: Michael C. Mandall, Mandall Armor Design & Manufacturing, Inc. 901 E. Madison St., Phoenix, AZ (US) 85034

( * ) Notice: Subject to any disclaimer, the term of this patent is extended or adjusted under 35 U.S.C. 154(b) by 0 days.

(21) Appl. No.: 10/627,030

(22) Filed: Jul. 25, 2003

(65) Prior Publication Data

US 2004/0041414 A1 Mar. 4, 2004

Related U.S. Application Data

(63) Continuation-in-part of application No. 10/232,148, filed on Aug. 30, 2002, now abandoned.

(51) Int. Cl.[7] ..... E05C 19/16
(52) U.S. Cl. ..... 292/251.5; 292/341.16
(58) Field of Search ..... 292/251.5, 341.16, 292/346; 24/303

(56) References Cited

U.S. PATENT DOCUMENTS

| | | | | | |
|---|---|---|---|---|---|
| 2,673,755 | A | | 3/1954 | Asp | 292/78 |
| 3,201,960 | A | * | 8/1965 | Berkowitz | 70/150 |
| 4,487,439 | A | * | 12/1984 | McFadden | 292/251.5 |
| 4,826,223 | A | | 5/1989 | Geringer et al. | 292/251.5 |
| 6,007,119 | A | * | 12/1999 | Roth et al. | 292/251.5 |
| RE36,652 | E | * | 4/2000 | Wang | 292/201 |
| 6,561,555 | B1 | * | 5/2003 | Millard | 292/251.5 |
| 2004/0026933 | A1 | * | 2/2004 | Smith | 292/251.5 |

FOREIGN PATENT DOCUMENTS

| | | | | |
|---|---|---|---|---|
| CH | 595 538 | * | 2/1978 | E05B/65/10 |
| GB | 2 123 472 A | | 5/1982 | E05C/19/16 |

* cited by examiner

*Primary Examiner*—Gary Estremsky
(74) *Attorney, Agent, or Firm*—Cahill, von Hellens & Glazer P.L.C.

(57) ABSTRACT

A pivotally mounted armature assembly is mechanically moved into engagement with an electromagnet assembly bringing the components of a secondary locking system between the assemblies into position to become active if a predetermined force is applied to slide the armature assembly across an energized electromagnet assembly.

8 Claims, 3 Drawing Sheets

ELECTROMAGNETIC DOOR LOCK

This application is a continuation-in-part of application Ser. No. 10/232,148 filed Aug. 30, 2002 now ABN.

TECHNICAL FIELD

This invention is concerned with improving the performance and reliability of shear-type electromagnetic locks.

BACKGROUND ART

Magnetic door latches have been employed in a variety of installations virtually since the discovery of magnetism. One such latch is disclosed in U.S. Pat. No. 2,673,755 granted Mar. 30, 1954 to H. L. Asp for "Magnetic Door Catch". In that latch an armature hingedly carried on the door is attracted to and held by a permanent magnet mounted on the top wall of a cabinet near the door.

When more secure locking arrangements are required it is customary to employ an electromagnet which is energized to close the lock and de-energized to open the lock.

UK patent application GB2123472A published Feb. 1, 1984 discloses an electromagnetic door lock employing a relatively small and weak electromagnet. Movement of the door away from the magnet causes a hook to be swung into a rod to mechanically link the door to the magnet housing. The rather frail mechanism would appear not to be suitable for a secure application.

One type of electromagnetic lock which is fairly simple in construction and can be installed in a variety of ways is the shear-type electromagnetic lock. U.S. Pat. No. 4,826,223 granted May 2, 1989 to A. V. Geringer et al. for "Electromagnetic Door Lock Device" discloses such a lock. In this device an electromagnet mounted in a door frame attracts, when energized, an armature loosely or flexibly mounted on the door and positioned to slide in alignment beneath the electromagnet when the door is closed.

In the shear-type lock the magnetic forces attracting the armature to the magnet are not sufficient to resist strong shear forces across the face of the magnet as the door is forced open. So these shear forces are opposed by some form of mechanical engagement between the armature and the magnet. In the locks disclosed in the Geringer et al. patent the mechanical engagement takes place when a member or members projecting from edges of either the magnet or the armature engage the other component when the armature moves into engagement with the magnet. This lock malfunctions, however, if the magnet is energized before the door is fully closed as the projection engages the other component before the magnet and armature are aligned and the door cannot be fully closed.

U.S. Pat. No. 6,007,119 granted Dec. 28, 1999 to T. E. Roth et al. for "Multi-Directional Self-Aligning Shear Type Electromagnetic Lock" seeks to solve the early energizing problem of Geringer by mounting the armature in a highly flexible, resilient mount and the projections on the armature are conical in configuration. The arrangement permits the armature to tilt and float over the face of the magnet until the projections become aligned with openings in the magnet.

A deficiency of the Roth et al. locks, which is shared incidently with the Geringer et al. locks, is that the flexible mounts for the armatures are weak and easily damaged. Such locks would not be suitable for applications where a great deal of security is involved.

Installations for storing classified military information require the highest degree of security and resistance to efforts to break into the installation.

SUMMARY OF THE INVENTION

This invention seeks to provide a shear-type electromagnetic lock which will function reliably under ordinary operating conditions, but securely resist being broken open by intruders.

In accordance with this invention there are two principal components as in other shear-type locks—an electromagnet assembly and an armature assembly. The magnet assembly comprises an electromagnet and an electromagnet holder including a component of a secondary locking system. The armature assembly comprises the armature, an armature holder including a second component of the secondary locking system, a pivotal mounting for the armature holder for movement from a first position away from the magnet to a second position near the magnet and means on the armature holder engagable with the magnet holder for moving the armature holder to its second position whereby the armature contacts the electromagnet when the armature and electromagnet are in alignment and the first and second components of the secondary locking system are aligned for possible engagement.

The components of the secondary locking system are designed to become operatively engaged when sufficient shearing force is applied to cause the armature to slide across the face of the electromagnet.

The lock further includes means on one of said assemblies for preventing engagement of said secondary locking components when the shear forces acting across the face of the electromagnet to defeat the lock do not exceed a predetermined amount and which permits engagement of the secondary locking components when the shear forces exceed the predetermined amount.

BRIEF DESCRIPTION OF THE DRAWINGS

The invention is described in greater detail hereafter by reference to the accompanying drawings wherein.

BEST MODES FOR CARRYING OUT THE INVENTION

Figure 1:
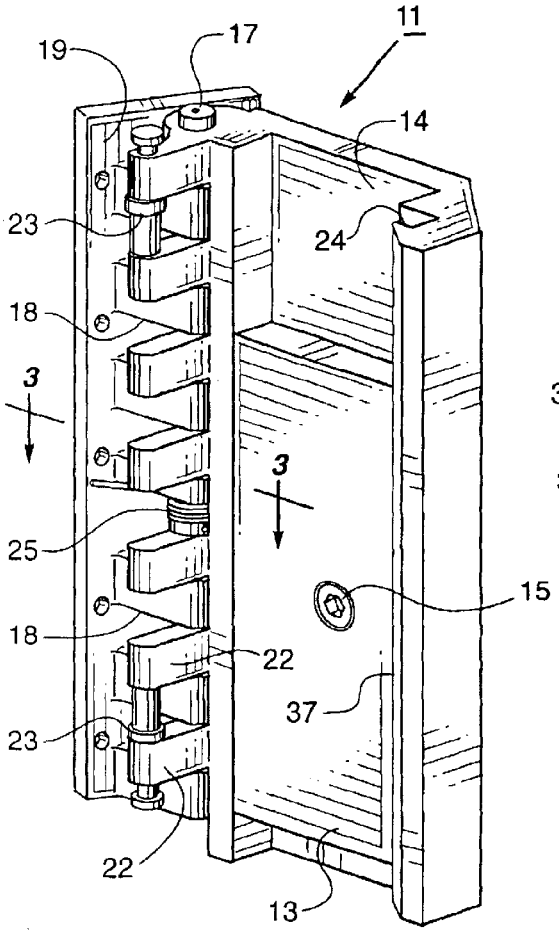
FIG. 1 is a perspective view of the operating face of an armature assembly for a lock of the invention.
Figure 2:
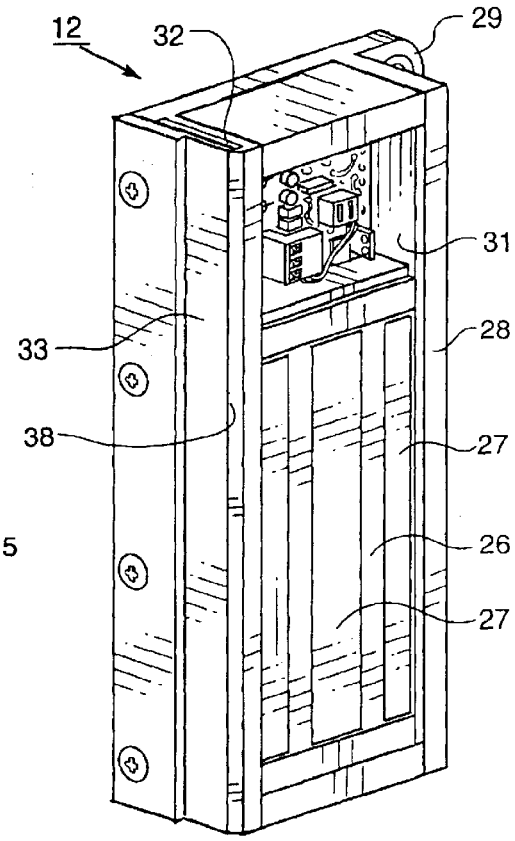
FIG. 2 is a perspective view of the operating face of an electromagnet assembly of this invention.

The two major components of the lock of this invention are depicted in FIGS. 1 and 2 with an armature assembly, indicated generally by reference numeral 11, appearing in FIG. 1 and an electromagnet assembly, indicated generally by reference numeral 12, appearing in FIG. 2.

Armature assembly 11 comprises a metal plate armature 13 secured inside an armature holder, or housing, 14. Armature 13 is preferably secured in housing 14 by means of a strong bolt-resilient washer combination 15 which permits limited tilting movement of the armature to compensate for slight misalignment of the armature assembly 11 with the electromagnet assembly 12.

Figure 3:
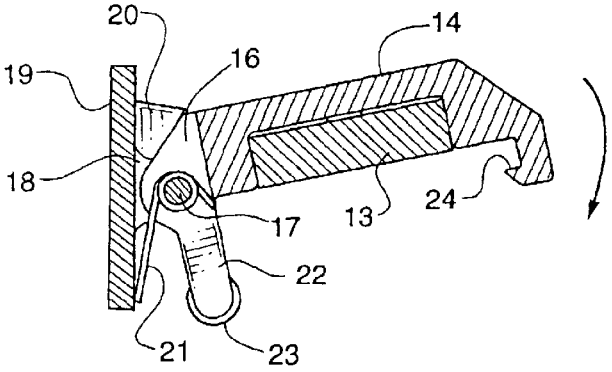
FIG. 3 is a sectional view through the armature assembly taken as indicated by line 3—3 in FIG. 1.

A side edge of armature housing 14 has a plurality of mounting lugs 16 projecting therefrom and pivotally connected by a hinge rod 17 to a plurality of trunnions 18 on a mounting plate 19. A helical spring 21 surrounding hinge rod 17 and acting between mounting plate 19 and armature housing 14 biases the armature housing toward the position depicted in FIGS. 1, 3 and 4 in which the lugs 16 contact a stop 20. This is a, so called, first or unlocked position for the armature 13.

The armature housing mounting lugs 16 also preferably have actuating arms 22 projecting at right angles from the face of armature 13. At least some of the actuating arms 22 have rollers 23 journaled thereon.

The free edge of the armature housing 14—the edge away from its pivotal mount—has a component of a secondary locking system found thereon, in this case a bolt 24.

Referring to FIG. 2, the electromagnet assembly of the lock comprises an electromagnet 26 having exposed poles 27 at its face. Electromagnet 26 is contained in a holder, or housing, 28 having a mounting flange 29 thereon. Housing 28 may also contain an electronic compartment 31 in the event the lock is equipped with circuitry for time delay energization or rapid de-energization of the electromagnet 26.

Along one side edge of electromagnet housing 28 there is formed a second component of a secondary locking system in the form of a strike 32. Entrance to the area beneath the strike 32 is normally blocked by a barrier plate, or shield, 33 mounted to the electromagnet housing 28.

For operation of the lock of this invention refer to FIGS. 4 through 7 wherein the armature assembly 11 is shown mounted on a door 35 and the electromagnet assembly is shown mounted on a door frame 36. It is to be understood, however, that positions of these components can be reversed.

Figure 4:
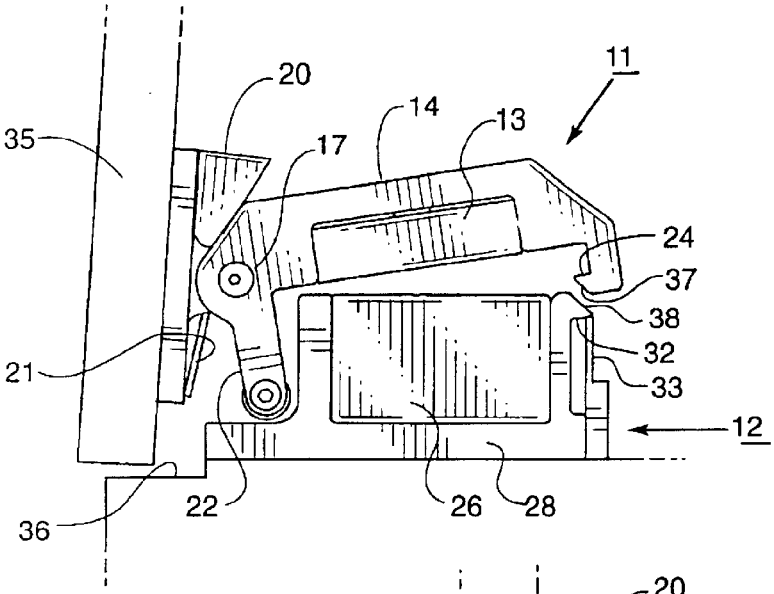
FIGS. 4 through 7 are schematic views illustrating cooperation between the armature assembly and the electromagnet assembly.

As door 35 is approaching closure as depicted in FIG. 4 spring 21 has armature assembly 11 biased to its first, or inactive, position as that assembly moves toward the electromagnet assembly 12. As the door moves closer to its closed position rollers 23 on arms 22 of the armature assembly 12 contact the side wall of electromagnet housing 28 and the armature assembly 12 is pivoted about rod 17 with the result that the armature 13 moves closer to and eventually contacts electromagnet 26. This is a so-called "second position" of armature assembly 11. The electromagnet 26, if not previously energized, is then energized holding the armature 13 in place and the lock is locked. If there has been no attempt at forced entry to alter the position of the lock components de-energizing electromagnet 26 releases the armature 13 allowing spring 21 to return armature assembly 12 to its first, or unlocked, position.

Figure 5:
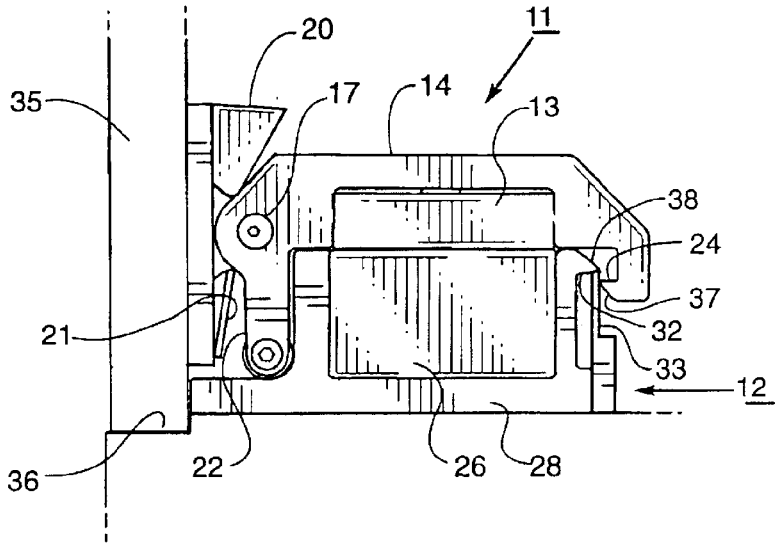

As best shown in FIG. 5 with the lock locked the components of the secondary locking system are positioned to become engaged if sufficient opening force is applied to the door to slide the armature 13 across the face of the electromagnet 26. The components of the secondary system are the bolt 24 on the armature housing 14 and the strike 32 on the electromagnet housing 28.

In applications where people occupy the space behind the locked door life safety codes require that the occupants be able to open the lock when the electromagnet 26 is de-energized. This means that the secondary locking components 23 and 32 must be prevented from accidently becoming engaged. This is the function of the barrier plate, or shield, 33. Plate 33 has sufficient strength or resistance to prevent armature assembly 11 from moving across electromagnet assembly 12 when the door 35 is accidently bumped, kicked or rammed.

Figure 6:
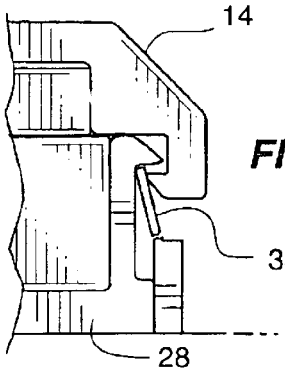
Figure 7:
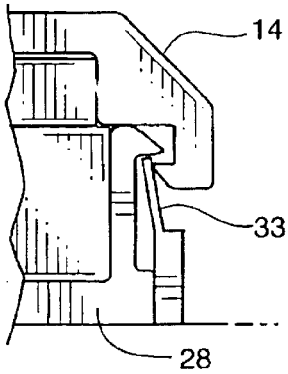

Barrier plate 33 may be in one of several forms. It may be formed of a frangible material, such as brittle metal, so that it breaks as shown in FIG. 6 when its resistance strength is exceeded, i.e., when a large force is used against the door. The plate 33 may also be formed of a malleable material that bends when its resistance strength is exceeded as shown in FIG. 7. Or it may be formed of a resilient material so it can return to its blocking position and permit reuse of the lock following an attempted break-in.

A further advantage of employing a resilient barrier plate 33 is that it can serve to separate the bolt 24 and strike 32 when the electromagnet is de-energized following an attempted break-in. Thus, people inside the enclosure can open the door.

If a panic bar (not shown) across the face of the door is employed to de-energize the electromagnet and the bar is struck heavily by a sturdy individual the door may not open. This is because the secondary locking components 23 and 32 may have been driven into engagement and the residual magnetic field from the electromagnet holds the armature 13 in the locked position. After several seconds, however, the magnetic field dissipates and the resilient barrier plate moves the secondary locking components out of engagement and the door can be opened.

Of course, the barrier plate 33 can be omitted for applications where no life safety concerns are involved as where no personnel ever occupy the locked enclosure. For that lock the force acting on the door 35 need only exceed that required to slide the armature 13 across the face of the electromagnet 26 to engage secondary locking components 24 and 32.

As mentioned above, some prior shear-type electromagnetic locks become jammed if the electromagnet is energized before the door is fully closed. The lock of this invention is designed to prevent that from happening. Armature housing 14 is provided with an inclined surface 37 which is positioned to contact an inclined surface 38 on electromagnet housing 28. If the armature 13 comes under the influence of the magnetic field from an energized electromagnet 26 before the lock is fully closed the inclined surfaces 37 and 38 work the armature housing 14 across the face of the electromagnet 26 until the armature 13 becomes fully aligned.

FIGS. 8 through 13 illustrate further modifications of the lock of this invention. Components common to this version of the lock and the lock depicted in FIGS. 1 to 7 are identified by common reference numerals.

Figure 8:
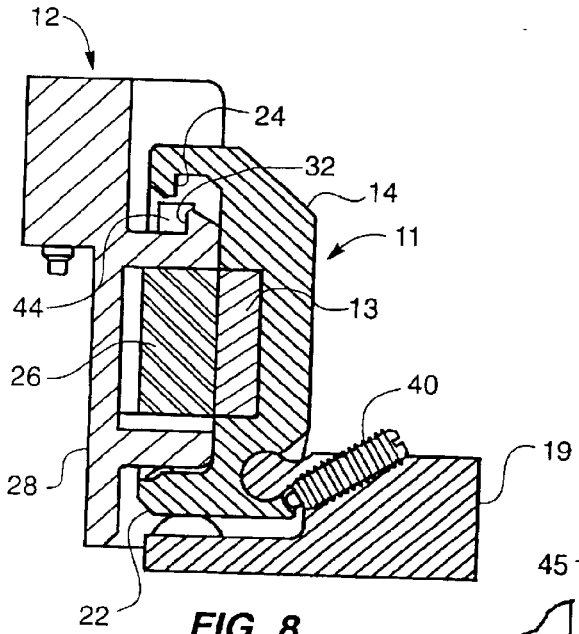
FIG. 8 is a sectional view through another modification of the lock of the invention.
Figure 9:
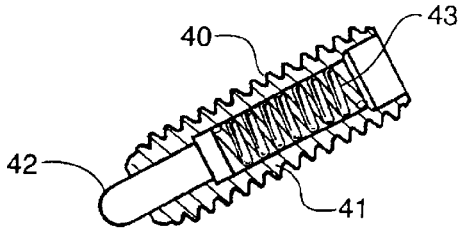
FIG. 9 is a sectional view of a spring plunger employed in the lock shown in FIG. 8.
Figure 11:
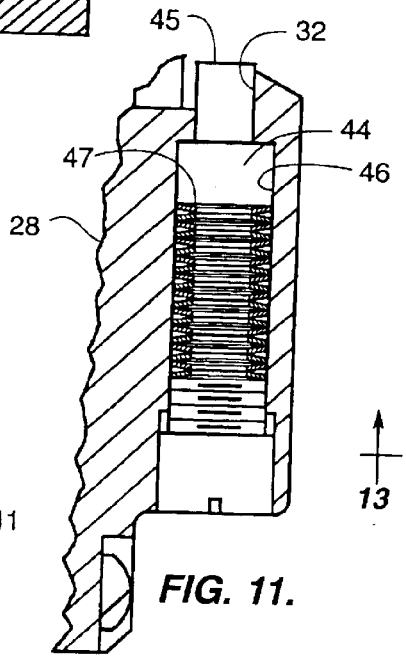
FIG. 11 is an enlarged sectional view of a portion of the lock shown in FIG. 10.

Referring specifically to FIG. 8 the lock comprises an armature assembly 11 and an electromagnet assembly 12. Armature assembly 11 is pivotally connected to a mounting plate 19 and comprises an armature 13 and an armature holder 14. Mounting plate 19 is normally fixed to a door (not shown).

The electromagnet assembly 12 is normally mounted on the door frame (also not shown) and comprises an electromagnet housing 28 and the electromagnet 26.

When the door is open the armature holder 14 is biased to the so called, "first" or unlocked position (not shown). In this embodiment the bias is provided by one or more adjustable spring plungers 40 shown in section in FIG. 9. Each plunger 40 comprises a threaded case 41 housing a nose 42 backed up by a spring 43. The biasing force is adjusted by screwing the plunger in and out of the mounting plate 19.

Figure 10:
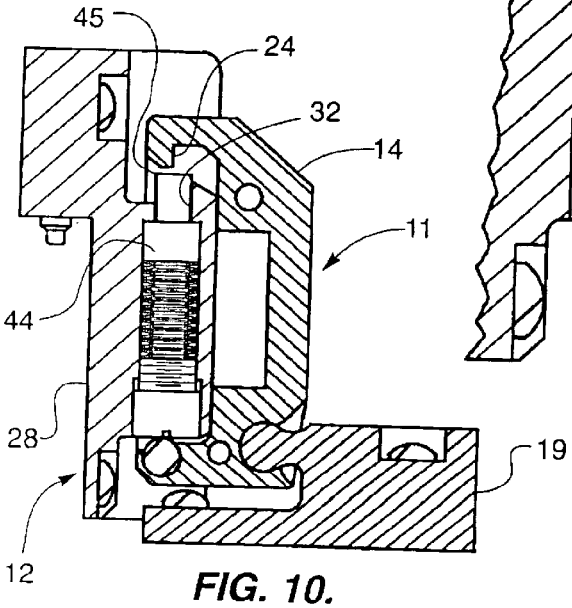
FIG. 10 is another sectional view of the lock of FIG. 8.

When the door is closed an actuating arm 22 on the armature housing 14 is contacted by the side wall of the electromagnet housing 28 moving the armature assembly 14 to its so called "second" position shown in FIGS. 8 and 10. In this position the components of the secondary locking system, namely, the bolt 24 on the armature housing 14 and the strike 32 on the electromagnet housing 28, are brought into alignment. The bolt 24 and the strike 32 are thus positioned to become operatively engaged if sufficient opening force is applied to the door to cause the armature 13 to slide across the face of the electromagnet 26 when the latter is energized.

This modification of the lock is also equipped with means for preventing the secondary locking components, bolt 24 and strike 32, from becoming engaged accidentally. This means takes the form of one or more spring loaded plungers 44 the noses 45 of which are designed to protrude slightly beyond the tip of strike 32 on the electromagnet housing 28.

Figure 12:
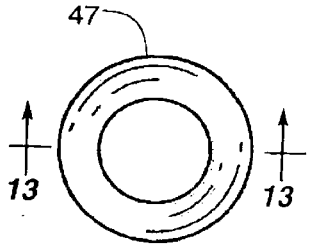
FIG. 12 is a plan view of a spring washer employed in the lock of FIG. 10.
Figure 13:
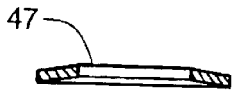
FIG. 13 is a sectional view of the washer of FIG. 12.

Plunger 44 is positioned in a bore 46 in housing 28. The bore 46 also houses a stacked array of spring washers 47 the configuration of which is shown in FIGS. 12 and 13. This type of spring is commonly referred to as a "Bellville washer". The end of the bore 46 is closed by a threaded plug 48. The amount of force by which the array of washers 47 resist movement of plunger 44 is adjusted by screwing plug 48 in or out of the bore 46.

The spring loaded plunger or plungers 44 function in the same manner as the resilient barrier plate 33, described above in reference to FIG. 7, and possesses all of the advantages alluded to with reference to the resilient barrier plate.

From the foregoing it should be apparent that this invention provides an improved shear-type electromagnetic lock which is capable of reliable operation and further capable of resisting serious attempts to defeat it.

What is claimed is:

1. An electromagnetic lock comprising:

an electromagnet assembly comprising:
an electromagnet and
an electromagnet holder including
a component of a secondary locking system;

an armature assembly comprising:
an armature;
an armature holder including a
second component of the secondary locking system;

a pivotal mounting for the armature holder permitting pivotal movement of the armature from a first position to a second position;

spring means biasing the armature holder toward the first position; and means on the armature holder engagable with the magnet holder for moving the armature holder to its second position whereby the armature contacts the electromagnet when the armature and electromagnet are in alignment;

the components of the secondary locking system being positioned to become operatively engaged when sufficient shear force is applied to cause the armature to move across the face of the electromagnet while the latter is energized.

2. The electromagnetic lock of claim 1 further comprising means on one of said assemblies for preventing operational engagement of said secondary locking components when the shear forces acting across the face of the electromagnet to defeat the lock do not exceed a predetermined amount and which permits engagement of the secondary locking components when the shear forces exceed the predetermined amount.

3. The electromagnetic lock of claim 1 wherein:

said secondary locking system component on said electromagnet assembly is a strike, and said secondary locking system component on said armature assembly is a bolt.

4. The electromagnetic lock of claim 2 wherein:

said secondary locking system component on said electromagnet assembly is a strike, and said secondary locking system component on said armature assembly is a bolt.

5. The electromagnetic lock of claim 2 wherein:

the means for preventing and permitting engagement of said secondary locking components is a frangible member.

6. The electromagnetic lock of claim 2 wherein:

the means for preventing and permitting engagement of said secondary locking components is a deformable member.

7. The electromagnetic lock of claim 6 wherein:

said deformable member is elastic.

8. The electromagnetic lock of claim 2 wherein:

the means for preventing and permitting engagement of said secondary locking components is a spring biased plunger positioned in said electromagnet assembly in the vicinity of the component of the secondary locking system on the electromagnet assembly.

* * * * *